US006634440B2

(12) United States Patent
Hoop et al.

(10) Patent No.: US 6,634,440 B2
(45) Date of Patent: Oct. 21, 2003

(54) TOOL FOR THE REMOVAL OF A DRILL CORE

(75) Inventors: Matthäus Hoop, Eschen (LI); Manfred Hartmann, Nenzing (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/127,260

(22) Filed: Apr. 22, 2002

(65) Prior Publication Data

US 2002/0153168 A1 Oct. 24, 2002

(30) Foreign Application Priority Data

Apr. 24, 2001 (DE) ..... 201 07 024

(51) Int. Cl.[7] ..... E21B 7/26; E21B 49/00
(52) U.S. Cl. ..... 175/20; 175/58
(58) Field of Search ..... 175/20, 58, 244, 175/249; 73/864.44, 864.45

(56) References Cited

U.S. PATENT DOCUMENTS 4,014,393 A * 3/1977 Hensel, Jr. ..... 175/58
4,598,777 A * 7/1986 Park et al. ..... 175/58
4,969,528 A * 11/1990 Jurgens ..... 175/58
5,467,657 A * 11/1995 Kakascik ..... 73/864.44
5,474,141 A * 12/1995 Hart ..... 175/20
6,095,259 A * 8/2000 Keyes ..... 175/20
6,237,429 B1 * 5/2001 Melnyk ..... 73/864.45

* cited by examiner

*Primary Examiner*—David Bagnell
*Assistant Examiner*—Brian Halford
(74) *Attorney, Agent, or Firm*—Sidley Austin Brown & Wood, LLP

(57) ABSTRACT

A tool for removing a drill core is formed of a tubular tool member (1) having an axially extending receptacle region (A) and an axially extending gripping region (B), wherein the receptacle region (A) extends partially around half of the circular annular circumference. In a first end of the receptacle region (A) spaced from the gripping region (B) two mutually opposed swivel arms (4) are arranged. The swivel arms (4) project into the inside diameter of the tool member (1) and extend in the direction of the gripping region (G) and are elastic in the radial direction. These swivel arms (4) serve in axially securing a drill core received in the receptacle region (A) of the tool member (1).

8 Claims, 1 Drawing Sheet

TOOL FOR THE REMOVAL OF A DRILL CORE

BACKGROUND OF THE INVENTION

Figure 1:
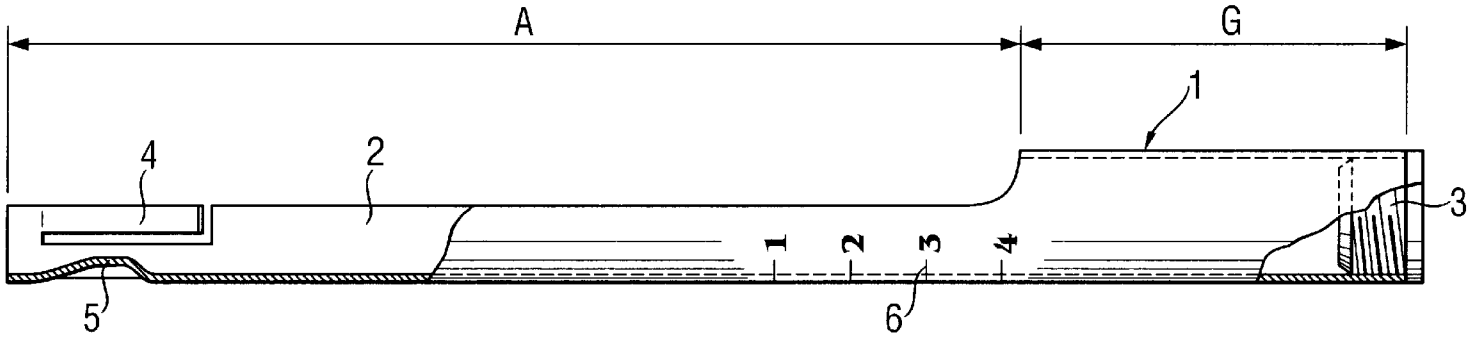

The invention concerns a tool member for removing a drill core formed of a gripping part and a receptacle part for engaging and removing the drill core.

In the creation of a large-diameter bore hole a drill bit is used, for example, as is described in U.S. Pat. No. 5,651,646. Using such a drill bit having a tubular carrier member, an annular cut out of a defined depth can be made in a receiving material. When the annular cutout is completed, a drill core is produced, which remains within the drill bit when an annular bore hole is made and the bit is withdrawn from the receiving material. In the case of a blind bore hole the drill core remains in the bore hole; that is, the drill core is still fixed to the remaining part of the receiving material, in the base portion of the cutout.

Such a drill core that is still fixedly attached to the remaining part of the receiving material is usually removed from the bore hole using various tools such as, for example, a turnscrew, or a davit or lifting dogs. Larger diameter drill cores are conventionally removed by inserting a dowel into the freely accessible face side of the drill core which can then be gripped by an appropriately powerful lifting tool.

Particularly in the case of the drill cores with a diameter of approximately 40 cm there is the risk that the drill core might break up and a drill core stump remains attached in the base of the bore hole in the receiving material. Such a bore core stump cannot be removed using the aforementioned tools.

The receiving material in which the annular cutout is formed may be rock, masonry or a similar hard material.

SUMMARY OF THE INVENTION

The object of the invention is to provide a tool member for removing a drill core from a bore hole in a receiving material and with which the entire drill core can be easily, safely and rapidly removed from the bore hole and which can be economically manufactured.

The object is achieved by a tool for removing a drill core having a gripping region and a receptacle region arranged to hold and remove the drill core from the receiving material.

By arranging an axially extending member into a receptacle region with at least half of a circular circumference, a tipping removal annular cutout formed in the receptacle region and extending about the drill core along the longitudinal axis of the bore hole is possible. When this is done, the drill core in the bottom zone of the annular cutout is broken off from the remaining part of the receiving material. On withdrawal of the tool according to the invention from the cutout, the drill core so detached remains in the receptacle region of the tool.

So that the drill core removed from the bore hole can be removed from the receptacle region of the tool, the receptacle region preferably extends around approximately half of the circular annular shaped circumference of the tool member.

The length of the receptacle region depends on the length of the drill core that must be removed. For practical purposes the receptacle region extends over 0.4 to 0.75 times the overall length of the tool member. The gripping region is preferable fashioned in a tubular shape so that the tool member can be gripped well in the operator's hand.

Due to manufacturing considerations, a pair of swivel arms are formed as part of the tool member.

Particularly when removing a drill core from an essentially vertically arranged bore hole which, for example, was drilled into the receiving material, both swivel arms hold the drill core in the receptacle region. The swivel arms preferably exhibit free ends facing the gripping end and project into the inside diameter of the member, so that the swivel arms can act as holding hooks.

Instead of tipping the tool out of the longitudinal axis of the bore hole, a lateral force can be applied to the drill core at the bottom of the annular cutout relative to the longitudinal axis of the bore hole using a ramp. Preferably, the ramp is located in the region of the swivel arms and projects into the inner diameter of the tool member. The height of the ramp increases in the direction of the gripping region. The ramp is particularly well suited to breaking the part of the already broken up drill core or drill core stump fragments that can no longer be removed using conventional tools.

To be able to prevent a removed drill core from falling out of the free end of the tool member in the gripping region, the tool member is expediently provided with a closure element at the free end of the gripping region.

Particularly long drill cores with large cores have heavier weights. Preferably, the closure element is positive locked with the tool member so that larger drill cores cannot by their great weight independently push the closure element out of the tool member, especially when the tool is held vertically.

Removal of the entire drill core is then only possible if the inventive tool can reach to the base of the annular cutout. It is possible that parts of the fragmented drill core can impair complete penetration of the tool member to the base of the annular cutout. In order to assist the operator in ascertaining such a blockage, a measurement scale is arranged on the tool member and can assist the operator in checking, whether the member is at the base of the annular cutout.

BRIEF DESCRIPTION OF THE INVENTION

Figure 2:
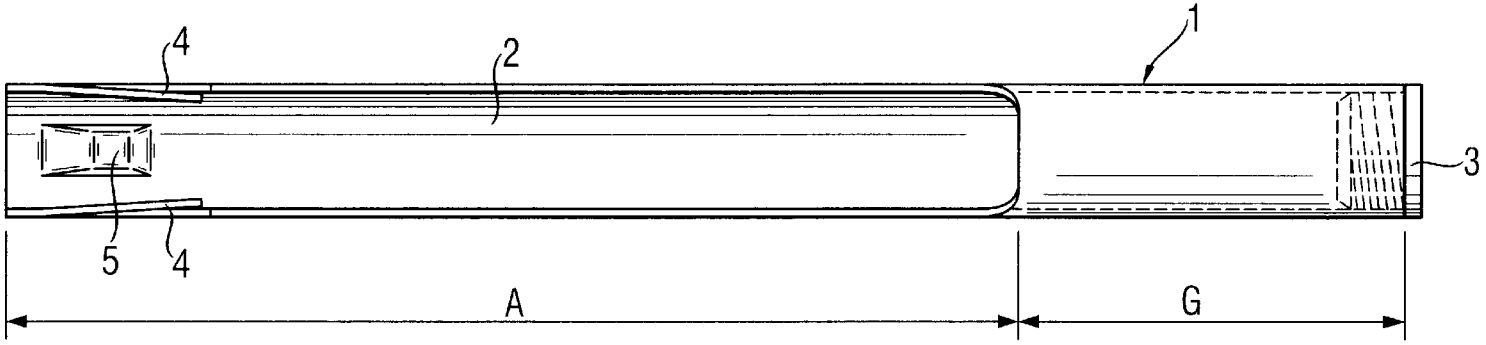

The invention is more completely explained read together with drawings which represent an exemplary embodiment, wherein:

FIG. 1 is an axially extending side view of a tool according to the invention for removing a drill core; with a closure element and without the drill core and the receiving material containing the drill core; and FIG. 2 is a side view of the tool according to FIG. 1 turned 90°; without the closure element; the drill core and the receiving material.

DETAILED DESCRIPTION OF THE INVENTION

The tool for removing a drill core (not shown) is comprised of a tubular tool member 1 with a receptacle region A and a gripping region G. The tool member has an axis. The receptacle region A forms an inside space 2 approximately half of a circular annular circumference. The receptacle region A forming the inside space 2 extends to over 0.7 times the overall axial length of the tool member 1. The gripping region or end G is tubular.

In a first or free end of the receptacle region A, at the left end in FIG. 1, spaced from the gripping region G, two radially elastic swivel arms 4 are arranged opposite to each other, and protruding into the inside diameter of the tool member 1. The oppositely arranged swivel arms 4 located adjacent the front end of the tool member 1 are part of the tool member 1 and fix the detached drill core (not shown) by increased friction in the receptacle region A, so that the drill core together with the tool member 1 can be drawn out of the annular bore hole (also not shown).

In the surrounding region between the swivel arms 4, a ramp 5 is provided that projects into the inside diameter of the tool member 1. The height of the ramp projecting into the tool member 1 increases in the direction toward the gripping region G. Since the height of the ramp together with the wall thickness of the tool member 1 exceeds the width of the annular cutout, on penetration of the tool member 1 into the annular cutout, the drill core is compressed laterally by a force, that results in a breaking off of the drill core from the remaining part of the receiving material at the base of the cutout.

The tool member 1 is provided with a closure element 3 at a second end, the right hand end in FIG. 1, which is, for example, positively locked via a threaded connection with the tool member 1. On penetration of the tool member 1 into an annular cutout of the receiving material, the operator can exert the desired pressure on the free face end of the closure element 3. Further, the closure element 3 prevents a falling out of the drill core through the second end of the tubular tool member 1 onto the operator, on removing drill cores from bore holes, which are formed, for example, in a ceiling. The closure element 3 is fashioned out of plastic.

A measurement scale 6, note FIG. 1, extending over a part of the length of the tool member 1, is arranged on the external face of the tool member 1, the measurement scale assists the operator in determining whether the tool member 1 penetrates to the base of the cutout. When doing this, the operator must merely compare that value on the measurement scale that lies at the same level as the receiving material of the receiving material with the depth of the previously bored annular cutout. If the values are identical, then the operator knows that the tool member 1 is located at the base of the cutout.

What is claimed is:

1. A tool for removing a drill core, comprising an elongated tool member (1) having an axis, first end, and an opposite second end, said tool member (1) comprises an axially extending receptacle region (A) extending from said first end and an axially extending gripping region (G) extending toward said receptacle region (A) from said second end, said receptacle region extends partially around said axis for approximately half of a circular annular circumference, and adjacent said first end said receptacle region (A) has two opposed axially extending swivel arms (4) projecting inwardly toward one another, and said swivel arms are elastic in the radial direction relative to said axis.

2. A tool, as set forth in claim 1, wherein said receptacle region (A) extends transverse to said axis for approximately half of a circular annular circumference.

3. A tool, as set forth in claim 1, wherein said receptacle region extends in the axial direction for 0.4 to 0.75 times the overall length of said member (1), and said gripping region (G) has a tubular shape.

4. A tool, as set forth in claim 1, wherein said swivel arms (4) are part of said member (1).

5. A tool, as set forth in claim 1, wherein said swivel arms (4) having free ends projecting inwardly toward said axis and facing toward said gripping region (G).

6. A tool, as set forth in claim 1, wherein in an axially extending region of said swivel arms (4) a ramp (5) projects inwardly from said receptacle region (A) toward said axis and said ramp (5) has an inwardly directed height increasing in the direction toward said gripping region (G).

7. A tool, as set forth in claim 1, wherein said member (1) at said second end has a closure element (3).

8. A tool, as set forth in claim 7, wherein said closure element (3) is in positively locked connection with said gripping region (G) of said member (1).

* * * * *